US011629475B2

(12) United States Patent
Wang et al.

(10) Patent No.: US 11,629,475 B2
(45) Date of Patent: Apr. 18, 2023

(54) RECYCLABLE PILE FOUNDATION

(71) Applicant: HAINAN UNIVERSITY, Haikou (CN)

(72) Inventors: Yongwei Wang, Haikou (CN); Qinxi Dong, Haikou (CN); Youliang Zhang, Haikou (CN); Xinying Song, Haikou (CN)

(73) Assignee: HAINAN UNIVERSITY, Haikou (CN)

( * ) Notice: Subject to any disclaimer, the term of this patent is extended or adjusted under 35 U.S.C. 154(b) by 0 days.

(21) Appl. No.: 17/939,633

(22) Filed: Sep. 7, 2022

(65) Prior Publication Data

US 2023/0081869 A1 Mar. 16, 2023

(30) Foreign Application Priority Data

Sep. 10, 2021 (CN) ..... 202111060177.7

(51) Int. Cl.
*E02D 27/12* (2006.01)
*E02D 5/56* (2006.01)
*E02D 5/54* (2006.01)

(52) U.S. Cl.
CPC ..... *E02D 27/12* (2013.01); *E02D 5/54* (2013.01); *E02D 5/56* (2013.01)

(58) Field of Classification Search
CPC .. E02D 27/12; E02D 5/52; E02D 5/54; E02D 5/24; E02D 5/28
See application file for complete search history.

(56) References Cited

U.S. PATENT DOCUMENTS

2010/0277290 A1 11/2010 Knudsen

FOREIGN PATENT DOCUMENTS

| | | | |
|---|---|---|---|
| CN | 203668920 | U | 6/2014 |
| CN | 104631454 | A | 5/2015 |
| CN | 210315507 | U | 4/2020 |
| CN | 111441649 | A | 7/2020 |
| CN | 211596744 | U | 9/2020 |
| CN | 211646381 | U | 10/2020 |
| CN | 213358594 | U | 6/2021 |

*Primary Examiner* — Sean D Andrish
(74) *Attorney, Agent, or Firm* — Slater Matsil, LLP

(57) ABSTRACT

A recyclable pile foundation is provided. The recyclable pile foundation includes several inner cylinders, several outer cylinders and several reciprocating components which are circumferentially distributed between the inner cylinders and the outer cylinders. Each reciprocating component includes several steel collars, a push-pull rod, a hold component and at least one motion component. The motion components are distributed along the push-pull rod. Each motion component includes at least one triangular connection plate, several connection rods, an inner wedge block, an outer wedge block, a motion block and a pointed rod. When the push-pull rod is pushed along its own axis to the pushed position, the pointed rod protrudes from the outer cylinders to increases the friction between the surrounding soil and the recyclable pile foundation. When the push-poll rod is pulled along its own axis to the pulled position, the pointed rods retract back into the outer cylinders.

7 Claims, 9 Drawing Sheets

RECYCLABLE PILE FOUNDATION

CROSS-REFERENCE TO RELATED APPLICATIONS

This application claims priority to Chinese Patent Application No. CN 202111060177.7, filed on Sep. 10, 2021, which is hereby incorporated herein by reference in its entirety.

TECHNICAL FIELD

The application belongs to the technical field of civil engineering, and particularly relates to a recyclable pile foundation.

BACKGROUND

Foundations provide support to the structure and transfer the loads from the structure to the soil. Foundations can be classified as shallow foundations and deep foundations. Shallow foundations are usually used when the bearing capacity of the surface soil is adequate to carry the loads imposed by a structure. On the other hand, deep foundations are usually used when the bearing capacity of the surface soil is not sufficient to carry the loads imposed by a structure.

Pile foundation, a kind of deep foundation, is a slender column or long cylinder made of materials such as concrete or steel which are used to support the structure and transfer the load at desired depth either by end bearing or surface friction.

Friction pile transfers the load from the structure to the soil by the frictional force between the surface of the pile and the soil surrounding the pile such as stiff clay, sandy soil, etc. Some large temporary structures (such as tower cranes, large-tonnage cranes and large-tonnage scaffolding, etc.) have very strict requirements on pile foundations, construction of which takes a lot of time and a high economical cost. However, when the temporary structure was removed, these costly pile foundations were abandoned. This leads to a huge waste.

SUMMARY

This and other problems are generally solved or circumvented, and technical advantages are generally achieved, by embodiments of the present application which provides a recyclable pile foundation.

Technical Problems

The application provides a recyclable pile foundation and intends to solve the technical problem that the piles foundations will be abandoned and wasted after use in the prior art.

Technical Solutions

In order to achieve the above purpose, the technical solution adopted in the present application is to provide a recyclable pile foundation. The pile foundation includes several inner cylinders and several outer cylinders. Both the inner cylinders and the outer cylinders are hollow structures. The several inner cylinders are coaxially distributed along the same axis (it is usually vertical) of all inner cylinders and forms a long segmented inner cylinder. Adjacent two inner cylinders are detachably connected. Similar to the several inner cylinders, the several outer cylinders are coaxially distributed forming a long segmented outer cylinder and adjacent two outer cylinders are detachably connected. The long segmented outer cylinder coaxially surrounds the long segmented inner cylinder. Each outer cylinder coaxially surrounds a corresponding inner cylinder. An outer cylinder is fixedly connected with its corresponding inner cylinder by several steel bars.

The pile foundation provided by the present application further includes several reciprocating components circumferentially distributed between the long segmented outer cylinder and the long segmented inner cylinder. Each reciprocating component includes several steel collars, a push-pull rod, a hold component and at least one motion component. Each steel collar is welded to a steel bar of the steel bars connected between an inner cylinder and an outer cylinder. The push-pull rod passes through all steel collars and is only movable along its own axis under the limitation of all steel collars. That means, the several steel collars are distributed along the axis of the push-pull rod. The hold component is configured to hold the push-pull rod in a pushed position or in a pulled position. When the push-pull rod is pushed from the pulled position to the pushed position or is pulled from the pushed position to the pulled position, some action will be triggered which will be described later. A head block is arranged at the upper end of the push-pull rod. The head block is detachably connected with the hold component. When the head block is connected with the hold component, the push-pull rod is fixed and kept in the pushed position or the pulled position. When the head block is disconnected with the hold component, the push-pull rod is movable and can be pushed and pulled.

The motion components are distributed along the push-pull rod. Each motion component includes at least one triangular connection plate, several connection rods, an inner wedge block, an outer wedge block, a motion block and a pointed rod. Both the inner and outer wedge blocks are fixedly connected to the push-pull rod through the triangular connection plates and the connection rods. Therefore, the inner and outer wedge blocks can move with the push-pull rod, i.e., when the push-pull rod is pushed and moves downward, the inner and outer wedge blocks move downward with the push-pull rod; and when the push-pull rod is pulled and moves upward, the inner and outer wedge blocks move upward with the push-pull rod. When the inner and outer wedge blocks move vertically (i.e., downward and upward), they drive the motion block to move horizontally. The inner wedge block is close to the inner cylinder and provided with a first inclined plane. The outer wedge block is close to the outer cylinder and provided with a second inclined plane that is opposite and parallel to the first inclined plane. The motion block has two inclined planes that match the first and second inclined plane, respectively. The motion block is arranged between the inner wedge block and the outer wedge block, and the two inclined planes of the motion block are slidably contact to the first inclined plane and the second inclined plane, respectively. Therefore, when the inner and outer wedge blocks move vertically with the push-poll rod, the first inclined plane or the second inclined plane applies a horizontal thrust to the motion block to drive the motion block move horizontally. Besides, because the motion block is limited by two steel bars of the steel bars connected between an inner cylinder and an outer cylinder, it is only movable in the horizontal direction.

A horizontal pointed rod is attached to the motion block. When the motion block moves horizontally, the pointed rod moves horizontally with the motion block to protrude from an outer cylinder or retract into the outer cylinder. The outer wedge block and the outer cylinder are provided with a first hole and a second hole, respectively, for the pointed rod to pass through.

When the push-pull rod is pushed along its own axis to the pushed position, the inner wedge block and the outer wedge block move with the push-pull rod to drive the motion block to move, and the pointed rod moves with the motion block and protrudes from the outer cylinder.

When the push-poll rod is pulled along its own axis to the pulled position, the inner wedge block and the outer wedge block move with the push-pull rod to drive the motion block to move, and the pointed rod moves with the motion block and retracts into the outer cylinder.

It is noted that the push direction or the pull direction can be either direction along the push-pull rod. The push direction and the pull direction are contrary to each other. For example, when the push-pull rod is parallel to the axis of the inner and outer cylinders and is vertical, the push direction can be either upward or downward. When the push direction is upward, the pull direction is downward. When the push direction is downward, the pull direction is upward.

Advantageous Effects of the Disclosure

Compared with the prior art, the advantageous effects of the recyclable pile foundation provided by the present application are as follows:

(1) There are reciprocating components between the inner cylinders and the outer cylinders. The pointed rods of the reciprocating components can protrude from the outer cylinders or retract into the outer cylinders, which allows the surface friction of the pile foundation to be changed. When the pointed rods protrude, the pointed rods insert into the soil, and the pile foundation has large surface friction and can bear huge load. When the pointed rods retract, the pile foundation has small surface friction and is easy to be taken out from the soil, thus achieving recycling. That means, the pile foundation provided by the present application is recyclable, thus solving the problem that the piles foundations will be abandoned and wasted after use in the prior art.

(2) The pile foundation provided by the present application includes a long segmented inner cylinder including several inner cylinders and a long segmented outer cylinder including several outer cylinders. The pile foundation provided by the present application is a segmented structure. Whether in the process of construction or recycling, the pile foundation can be operated segment by segment, which is efficient and low cost. Besides, the segmented structure makes it easy to change the axial length of the pile foundation, which enables the pile foundation to easily adapt to different depths of foundation pits. The deeper the foundation pit, the more the segments used.

(3) Each reciprocating component has a hold component. The hold component can keep the push-pull rod in the pushed position or in the pulled position to keep the pointed rods protruding or retracting, so as to keep the pile foundation provided by the present application in the desired state.

(4) The pile foundation provided by the present application increases the friction by the pointed rods, instead of by increasing the axial length of the pile foundation (so as to increase the friction surface of the pile foundation) as in the prior art. This reduces the axial length of the pile foundation, thus reducing the manufacturing materials and construction length and cost of the pile foundation.

DETAILED DESCRIPTION OF ILLUSTRATIVE EMBODIMENTS

In order to make the technical problems to be solved by the present application, technical solutions and advantageous effects clearer, the present application will be further described in detail below with reference to the accompanying drawings and embodiments. It should be understood that the specific embodiments described herein are only used to explain the present application, but not to limit the present application.

Figure 1:
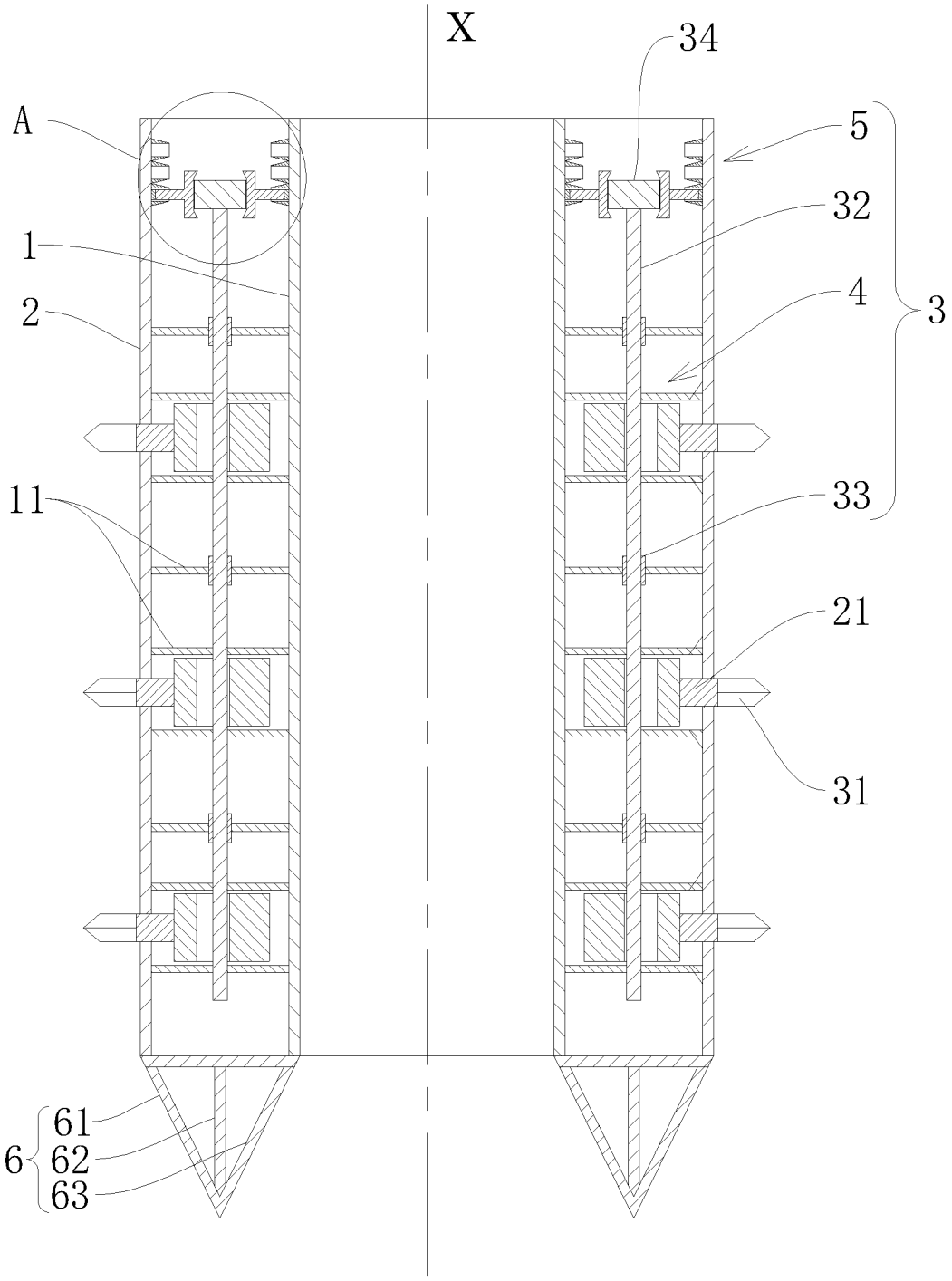
FIG. 1 is a schematic sectional view of the recyclable pile foundation according to embodiments of the present application.

In one embodiment, with reference to FIG. 1, the recyclable pile foundation provided by the present application includes at least two inner cylinders 1 and at least two outer cylinders 2. Both the inner cylinders 1 and the outer cylinders 2 are hollow structures. All the inner cylinders 1 are coaxially distributed along the axis X which is usually vertical. The axis X is the axis of all the inner cylinders 1 and outer cylinders 2. Adjacent two inner cylinders 1 are detachably connected by the means known in the art such as threaded connection. All inner cylinders 1 forms a long segmented inner cylinder. The outer cylinders 2 coaxially surround the inner cylinders 1 and each outer cylinder 2 corresponds to an inner cylinder 1. All outer cylinders 2 forms a long segmented outer cylinder. Adjacent two outer cylinders 2 may be detachably connected by the means known in the art.

An outer cylinder 2 is fixedly connected with a corresponding inner cylinder 1 by at least two steel bars 11. The steel bars 11 are connected between the outer cylinder 2 and the corresponding inner cylinder 1. The steel bars 11 can firmly connect the outer cylinder 2 and the corresponding inner cylinder 1. The outer cylinder 2 and the corresponding inner cylinder 1 form a segment of the recyclable pile foundation provided by the present application. In other words, the recyclable pile foundation is segmented structure and it can be constructed and recycled segment by segment. This makes both the construction and the recycling process efficient and low cost. Besides, the segmented structure makes it easy to change the axial length of the recyclable pile foundation. When the required axial length of the recyclable pile foundation is longer, more segments are used. On the contrary, when the required axial length of the recyclable pile foundation is shorter, less segments are used.

Figure 2:
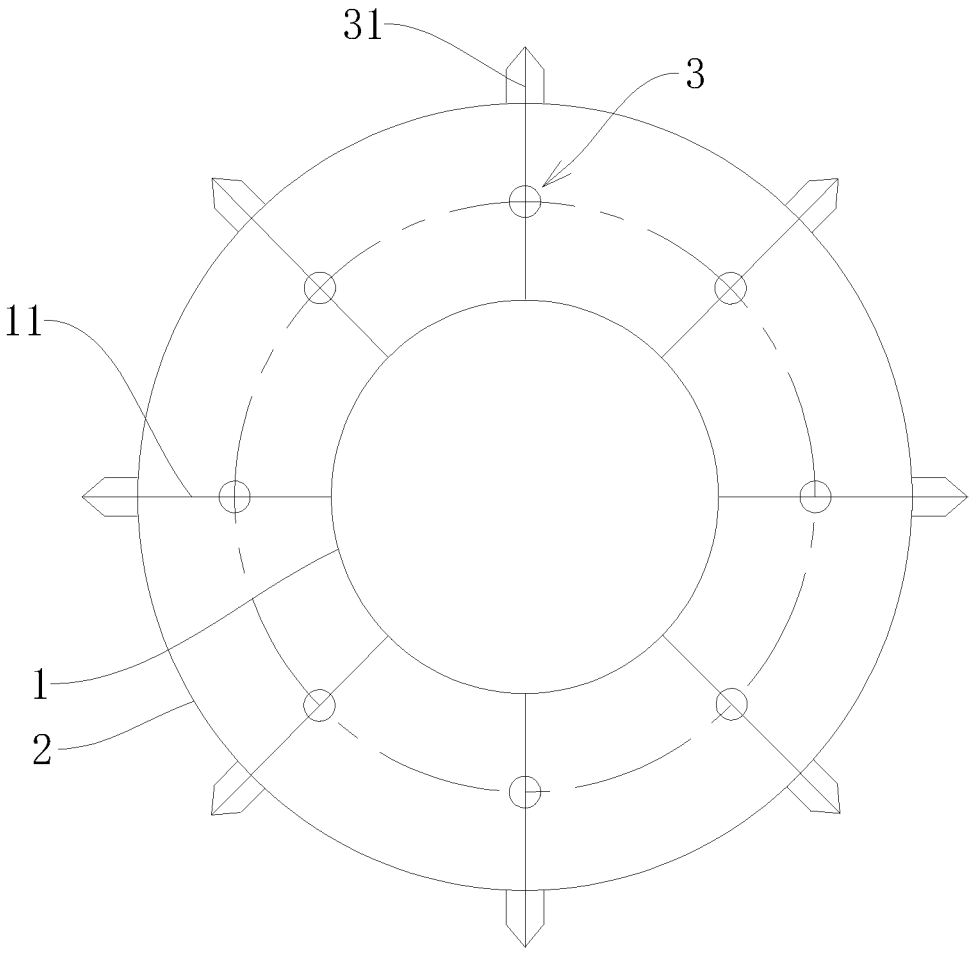
FIG. 2 is a schematic top view of the recyclable pile foundation according to embodiments of the present application.

The recyclable pile foundation provided by the present application further includes at least three reciprocating components 3, as shown in FIG. 1. Each reciprocating component includes at least two steel collars 33 which are hollow structure, a push-pull rod 32, a hold component 5 and at least one motion component 4. The reciprocating components 3 are circumferentially distributed between the inner cylinders 1 and the outer cylinders 2, as shown in FIG. 2.

As shown in FIG. 1, the steel collars 33 are fixedly welded to the steel bars 11, respectively. A steel collar 33 may be arranged at the middle of a steel bar 11 and divides the steel bar 11 into two sections. The two sections are both fixedly welded with the steel collar 33. The steel collars 33 are distributed along the push-pull rod 32. The push-pull rod 32 passes through all steel collars 33 and is only movable along its own axis under the limitation of the steel collars 33. The push-pull rod 32 is parallel to the axis X and is usually vertical.

The hold component 5 is configured to hold the push-pull rod 32 in a pushed position or in a pulled position. The pushed position and the pulled position are two different positions of the push-pull rod 32 along its own axis. The hold component 5 is detachably connected with the push-pull rod 32. When the push-pull rod 32 is disconnected with the hold component 5, the push-pull rod 32 can move along its own axis and switch between the pushed position and the pulled position. And when the switching is finished (at this time, the push-pull rod 32 is at the pushed-position or the pulled position), the push-poll rod 32 can be kept at the pushed position or the pulled position by the hold component 5.

When the push-pull rod 32 switches between the pushed position and the pulled position, the pointed rods 31 of the motion components 4 switches between a protruded state and a retracted state. In the protruded state, the pointed rods 31 protrude from the outer cylinders 2, the friction between the recyclable pile foundation and the surrounding soil is very large and the recyclable pile foundation can bear huge load. In the retracted state, the pointed rods 31 retract into the outer cylinders 2, the friction between the recyclable pile foundation and the surrounding soil is small and the recyclable pile foundation can be easily taken out from the soil to realize recycling.

Figure 14:
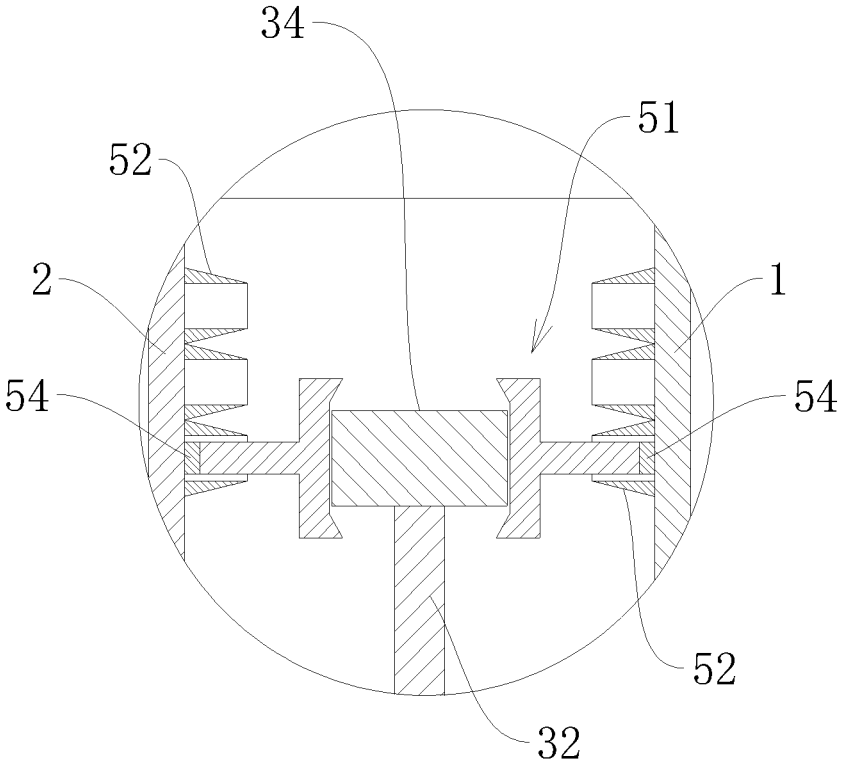
FIG. 14 is an enlarged view of part A in FIG. 1.

The hold component 5 is detachably connected with the push-pull rod 32 through a head block 34. The hold component 5 is detachably connected with the head block 34. The head block 34 is detachably connected with the upper end of the push-pull rod 32 by the means known in the art such as threaded connection. For example, the head block 34 may be provided with a threaded hole and the upper end of the push-pull rod 32 may be provided with a thread that matches with the threaded hole. In this way, the head block 34 not only realizes the detachable connection between the hold component 5 and the push-pull rod 32, but also the head block 34 can realize the lengthening of itself. That is, another push-pull rod coaxial with the existing push-pull rod 32 can be connected to the head block 34 easily so as to length the existing push-pull rod 32. FIG. 1 also includes a portion as shown within a circle A, and the portion is referred to as "part A". An enlarge view of part A is shown in FIG. 14, which shows the structure of part A.

Figure 3:
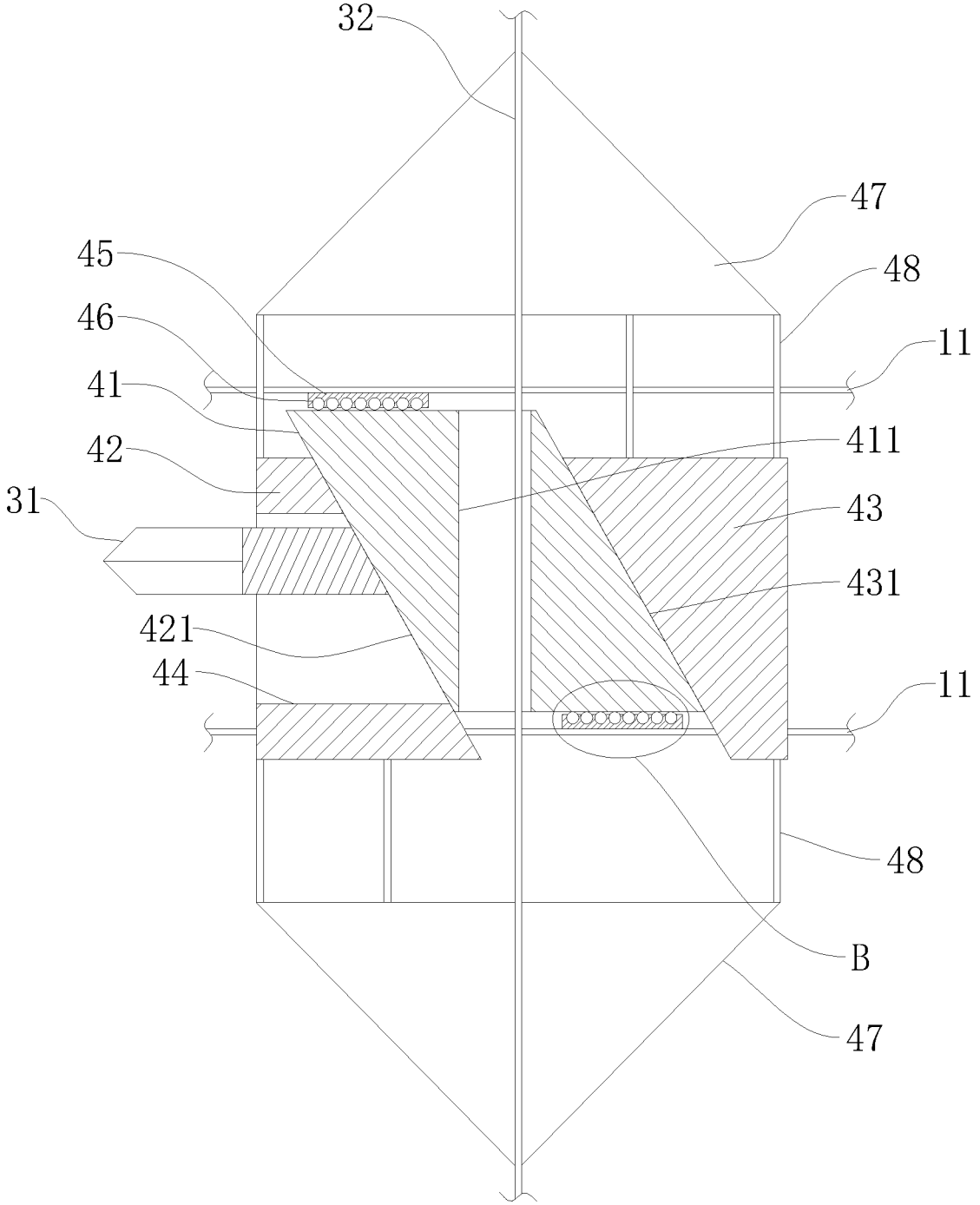
FIG. 3 is a schematic frontal sectional view of the motion component of the recyclable pile foundation according to embodiments of the present application.
Figure 4:
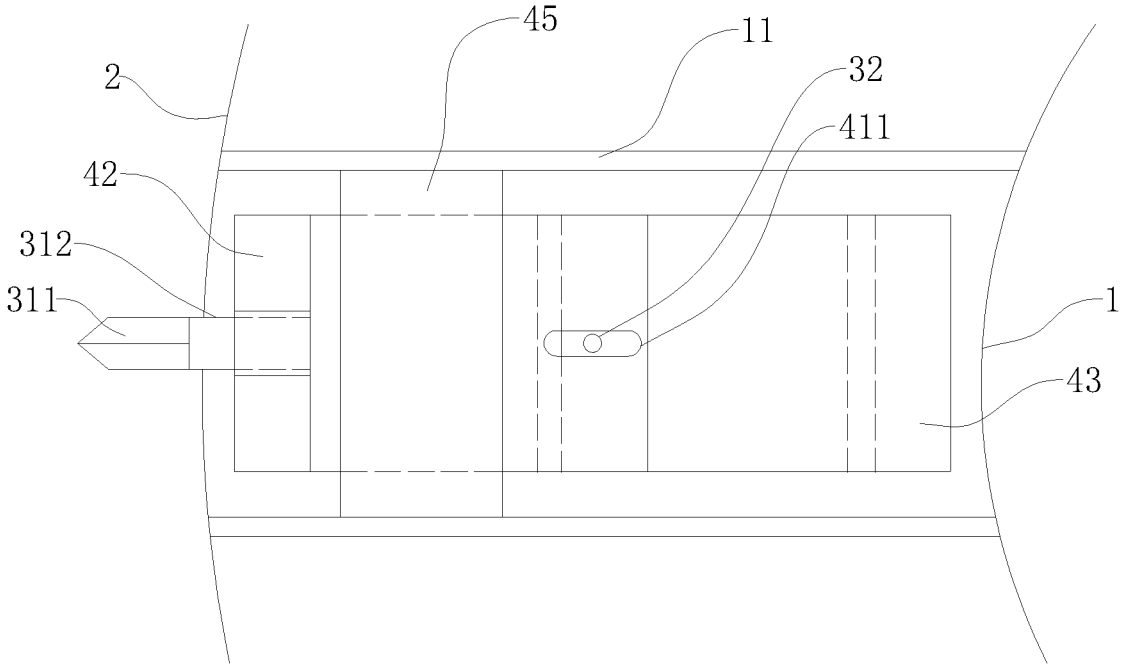
FIG. 4 is a schematic top view of the motion component of the recyclable pile foundation according to embodiments of the present application.
Figure 5:
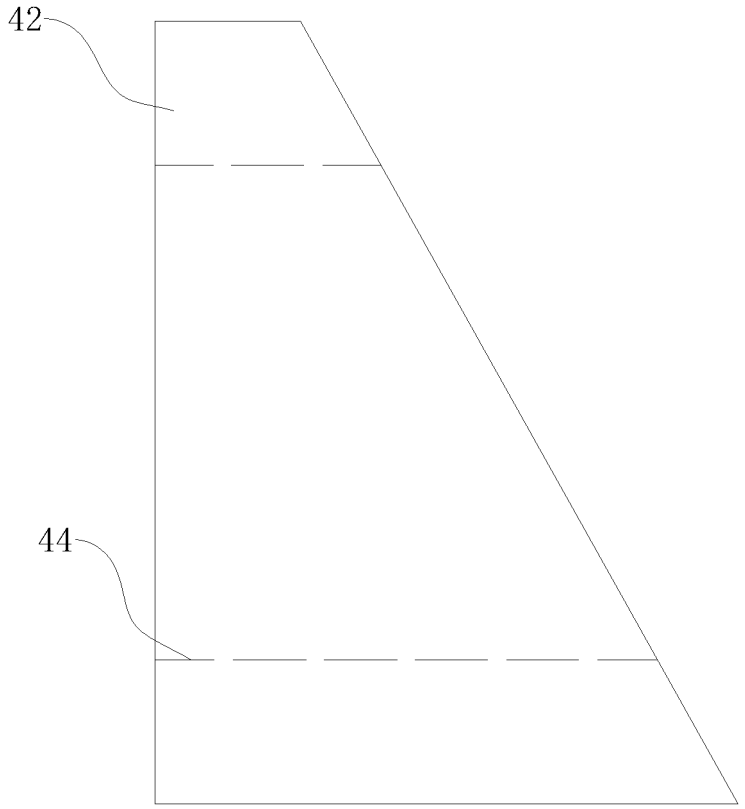
FIG. 5 is a schematic front view of the outer wedge block of the recyclable pile foundation according to embodiments of the present application.
Figure 6:
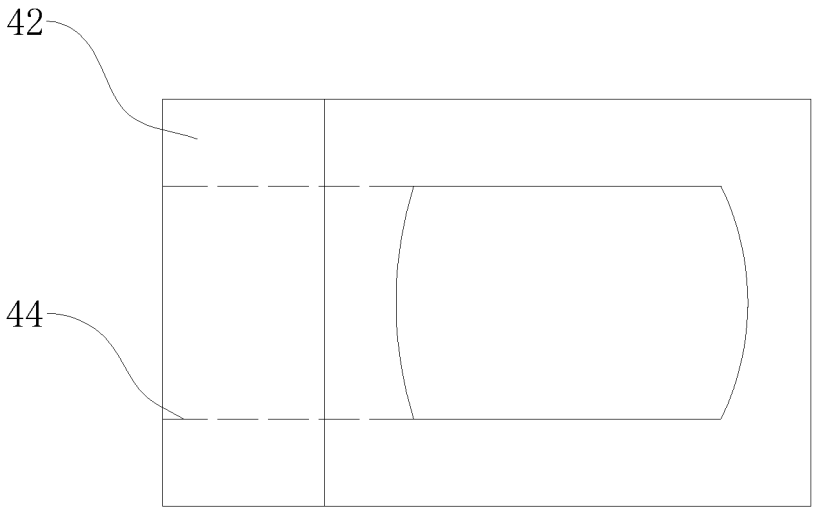
FIG. 6 is a schematic top view of the outer wedge block of the recyclable pile foundation according to embodiments of the present application.

The motion components 4 are distributed along the push-pull rod 32, as shown in FIG. 1. Referring to FIG. 3 and FIG. 4, a motion component 4 includes at least one triangular connection plate 47, a plurality of connection rods 48, an inner wedge block 43, an outer wedge block 42, a motion block 41 and a pointed rod 31.

The triangular connection plates 47 and the connection rods 48 are used to fix the inner wedge block 43 and the outer wedge block 42 on the push-pull rod 32. The triangular connection plates 47 are fixedly connected to the push-pull rod 32. The connection rods 48 are fixedly connected to the triangular connection plates 47. The inner and outer wedge blocks are fixedly connected to the connection rods 48. The inner wedge block 43 and the outer wedge block 42 are fixedly connected to the push-pull rod 32, therefore, they are only movable along the push-pull rod 32 which is limited by the steel collars 33.

In FIG. 3, there are two triangular connection plates 47 which are distributed above and below the inner and outer wedge blocks, respectively. Either of the two triangular connection plates 47 connects the inner and outer wedge block through three connection rods 48.

Referring to FIG. 3 and FIG. 4, the inner wedge block 43 is close to the inner cylinder 1 and provided with a first inclined plane 431. The outer wedge block 42 is close to the outer cylinder 2 and provided with a second inclined plane 421 that is opposite and parallel to the first inclined plane 431. The motion block 41 has two inclined planes that match the first inclined plane 431 and second inclined plane 421, respectively. The motion block 41 is arranged between the inner wedge block 43 and the outer wedge block 42. The two inclined planes of the motion block 41 are slidably contact to the first inclined plane 431 and the second inclined plane 421, respectively.

The first inclined plane 431 and the second inclined plane 421 deviate from the vertical by a certain angle. The inner wedge block 43 and the outer wedge block 42 drive the motion block 41 to move through the first inclined plane 431 and the second inclined plane 421. The following takes FIG. 3 as an example to illustrate how the inner wedge block 43 and the outer wedge block 42 drive the moving block 41 to move. When the inner wedge block 43 and the outer wedge block 42 move with the push-pull rod 32 downward, the first inclined plane 431 exerts a downward leftward force on the motion block 41. The motion block 41 is only movable leftward and rightward under the limitation of the steel bars 11 which slidably contact the top surface and the bottom surface of the motion block 41, respectively. That means, the motion block 41 can't move upward and downward. Therefore, the downward force component in the downward leftward force exerted by the first inclined plane 431 is cancelled out. Thus, the motion block 41 moves leftward. The pointed rod 31 moves leftward with the motion block 41 passing through the first hole 44 arranged at the outer wedge block 42 and a second hole 21 (shown in FIG. 1) arranged at the outer cylinder 2. Then the pointed rod 31 protrudes from the outer cylinder 2 and inserts into the soil that surrounds the outer cylinders 2. On the contrary, when the inner wedge block 43 and the outer wedge block 42 move with the push-pull rod 32 upward, the second inclined plane 421 exerts an upward rightward force on the motion block 41. The upward force component in the upward rightward force exerted by the second inclined plane 421 is cancelled out, thus the motion block 41 moves rightward. The pointed rod 31 moves rightward with the motion block 41 and retracts into the outer cylinder 2.

The push-pull rod 32 is paralleled to the axis X which is usually vertical. Therefore, the push-pull rod 32 is usually vertical. In FIG. 3, the up-down direction is the vertical direction, and the left-right direction is the horizontal direction. In FIG. 3, when the push-pull rod 32 moves downward, it is in the pushed position and the pointed rod 31 protrudes. When the push-pull rod 32 moves upward, it is in the pulled position and the pointed rod 31 retracts.

Figure 8:
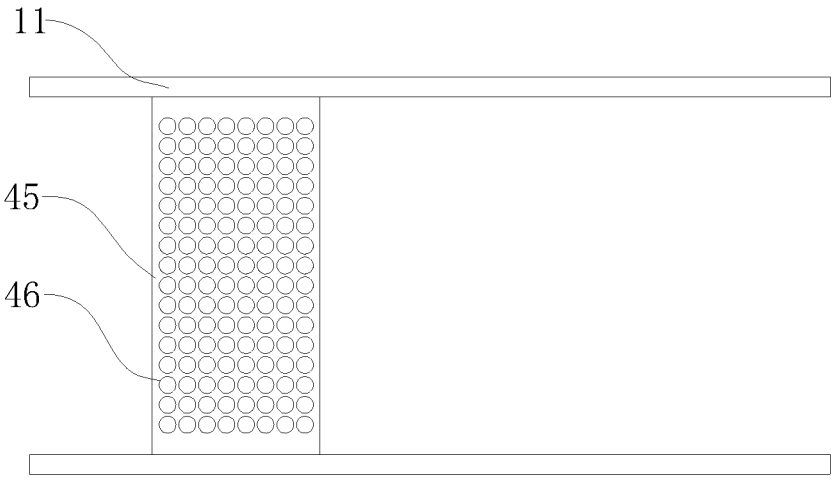
FIG. 8 is a schematic top view of two steel bars and a limiting steel plate of the recyclable pile foundation according to embodiments of the present application, where the limiting steel plate is fixed to the two steel bars and is attached by several steel balls.
Figure 11:
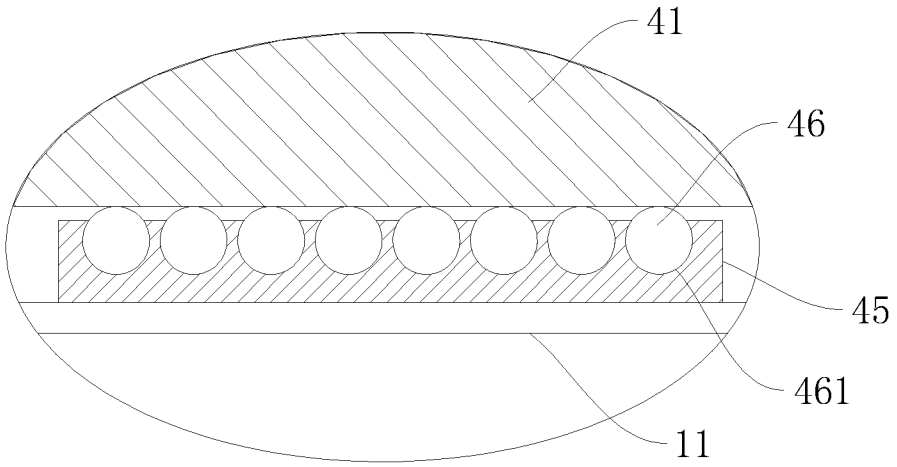
FIG. 11 is an enlarged view of part B in FIG. 3.

In one embodiment, with reference to FIG. 3, FIG. 8 and FIG. 11, the two steel bars 11 limit the motion block 41 through two limiting steel plates 45. An enlarged view of a limiting steel plate 45, which is circled and referred to as part B in FIG. 3, is shown in FIG. 1*i*. Each limiting steel plate 45 is attached by a plurality of rotatable steel balls 46. One limiting steel plate 45 is close to the top surface of the motion block 41 and the plurality of rotatable steel balls 46 attached to it rotatably contact the top surface of the motion block 41. The other limiting steel plate 45 is close to the bottom surface of the motion block 41 and the plurality of rotatable steel balls 46 attached to it rotatably contact the bottom surface of the motion block 41.

In FIG. 3, the limiting steel plates 45 with steel balls 46 not only restrict the motion block 41 from moving up and down, but also ensure the motion block 41 moving left and right smoothly. The top and bottom surface of the motion block 41 are usually plane and the longitudinal section of the moving block 41 is a parallelogram formed by four section lines of the top surface, bottom surface, the first inclined plane 431 and the second inclined plane 421, as shown in FIG. 3.

The steel balls 46 may be attached to the limiting steel plate 45 by the means known in the art. For example, the limiting steel plate 45 may be divided to base layer and cover layer. The base layer is fixedly connected to the steel bar 11 and is provided with hemispherical concaves. The cover layer may be detachably connected to the base layer by screws. The cover layer is provided with concaves matched with the hemispherical concaves arranged at the base layer. A concave of cover layer and a hemispherical concave of base layer form a mounting cavity 461, as shown in FIG. 11, which can hold a steel ball 46. The steel ball 46 in the mounting cavity can't move but rotate.

Referring to FIG. 3 and FIG. 4, the motion block 41 is provided with a through hole 411 for the push-pull rod 32 to pass through, where the cross section of the through hole 411 is bar-shaped as shown in FIG. 4. The through hole 411 penetrates the motion block 41 from top to bottom, as shown in FIG. 3. The cross section of the through hole 411 is bar-shaped to prevent the push-pull rod 32 from blocking the motion block 41 moving. In FIG. 3, the motion block 41 moves left and right, but the push-pull rod 32 doesn't move left and right. Therefore, the motion block 41 moves left and right relative to the push-pull rod 32. The through hole 411 with bar-shaped cross section supplies space for the relative movement.

Figure 7:
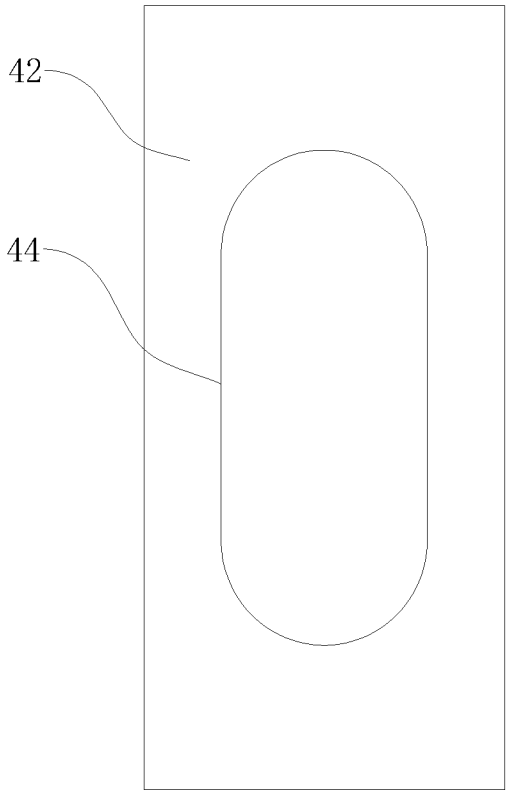
FIG. 7 is a schematic left view of the outer wedge block of the recyclable pile foundation according to embodiments of the present application.

Similarly, the first hole 44 of the outer wedge block 42 is also bar-sharped, as shown in FIG. 7. FIG. 3, FIG. 5, FIG. 6 and FIG. 7 show the shape of the outer wedge block 42 and the first hole 44. Referring to FIG. 3, the outer wedge block 42 moves up and down, and the pointed rod 31 moves left and right with the motion block 41. The first hole 44 supplies space for the relative movement between the pointed rod 31 and the outer wedge block 42.

Figure 12:
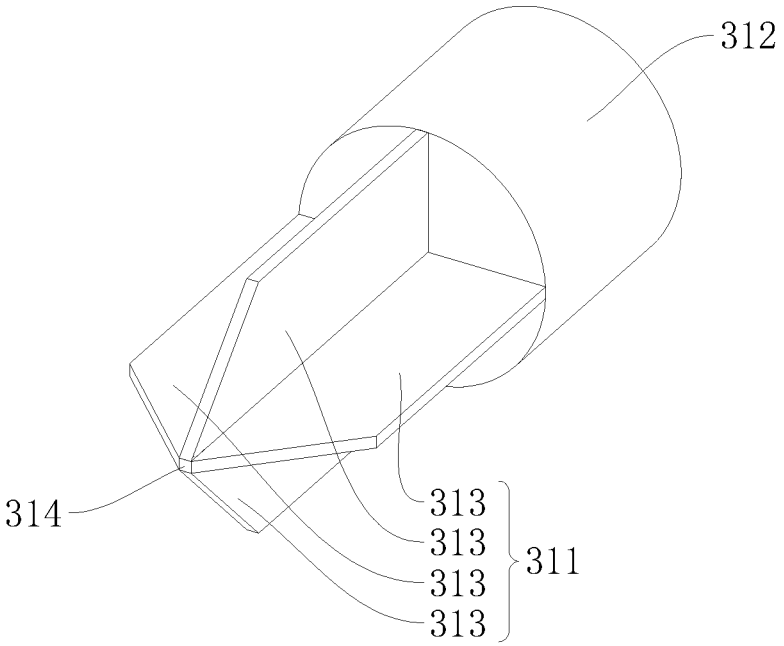
FIG. 12 is a perspective view of the pointed rod of the recyclable pile foundation according to embodiments of the present application.

In one embodiment, referring to FIG. 4 and FIG. 12, the pointed rod 31 is bullet-shaped and includes a cylindrical body 312 and an apex portion 311 including at least three right-angled trapezoidal steel plates 313 forming a pointed end 314. In FIG. 12, there are four right-angled trapezoidal steel plates 313. The bottom sides of the four right-angled trapezoidal steel plates 313 coincide. The angle between the surfaces of two adjacent right-angled trapezoidal steel plates 313 is 90 degrees. The cylindrical body 312 is used to being fixedly connected with the motion block 41. The apex portion 311 provided by this embodiment can easily insert into or be pulled out from the surrounding soil. After inserting into the soil, the apex portion 311 can produce large bearing force. The bearing force includes not only the friction between the right-angled trapezoidal steel plates 313 and the cylindrical body 312 (if the cylindrical body 312 is long enough to protrude from the outer cylinders 2) and soil, but also the support force produced by the soil under the right-angled trapezoidal steel plates 313 which are horizontal.

In one embodiment, referring to FIG. 1, the recyclable pile foundation provided by the present application further includes a ring seal portion 6 which is used to seal the ring gap between the bottom end of the inner cylinders 1 and the bottom end of the outer cylinders 2. The longitudinal section of the ring seal portion 6 is cone-shaped with the tip of the cone pointing down. When the recyclable pile foundation is used, it may be inserted downward into soil. The ring seal portion 6 prevents soil from entering into the gap of the inner cylinders 1 and the outer cylinders 2. The bottom end of the inner cylinders 1 may be a circular open end. This open end doesn't need to be sealed. That means soil can go into the inner part of the inner cylinders 1.

Referring to FIG. 1, the ring seal portion 6 may include a first ring plate 61 and a second ring plate 63 which are fixedly connected to the bottom end of the outer cylinders 2 and the bottom end of the inner cylinders 1, respectively. The ring seal portion 6 may further include a reinforcing member 62 used to increase the strength of the ring seal portion 6. When the strength of the ring seal portion 6 is increased, it can bear the pressure from soil better in the process of the recyclable pile foundation inserting downward into soil.

Figure 9:
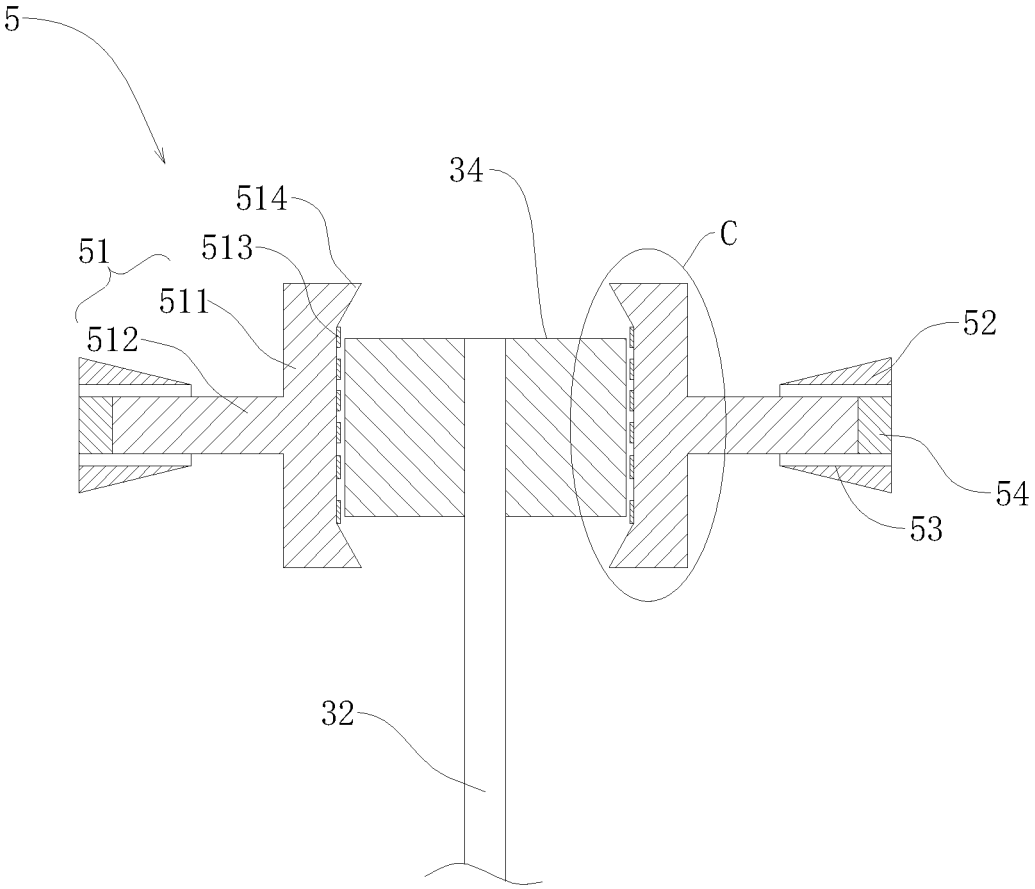
FIG. 9 is a schematic frontal sectional view when the inserting rods of clamping blocks insert into the block holders and the clamping portions of the clamping blocks fixedly clamp the head block arranged at the upper end of the push-pull rod.
Figure 13:
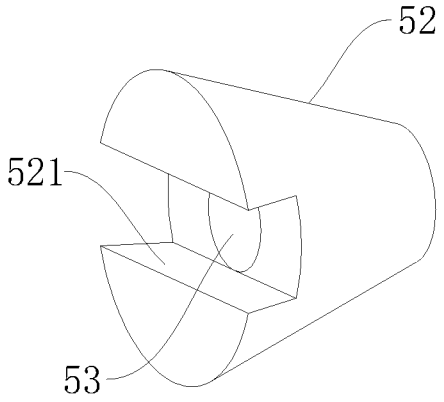
FIG. 13 is a perspective view of the block holder of the recyclable pile foundation according to embodiments of the present application.

In one embodiment, referring to FIG. 1, FIG. 9, FIG. 1 and FIG. 13, the hold component includes two clamping blocks 51, at least two pairs of block holders 52 and two steel blocks 54. The two clamping blocks 51 are arranged in opposition to each other and used to clamp the head block 34 arranged at the upper end of the push-pull rod 32 so as to hold the push-pull rod 32 in the pushed position or in the pulled position. The pairs of block holders 52 are distributed along the push-pull rod 32, where each pair of block holders 52 includes two block holders 52 arranged in opposition to each other. The two block holders 52 of a pair of block holders 52 are used to detachably fix the two clamping blocks 51, respectively. One block holder 52 of a pair of block holders 52 is fixed on a top inner cylinder 1 of the inner cylinders 1. The other block holder 52 of the pair of block holders 52 is fixed on a top outer cylinder 2 of the outer cylinders 2.

Figure 10:
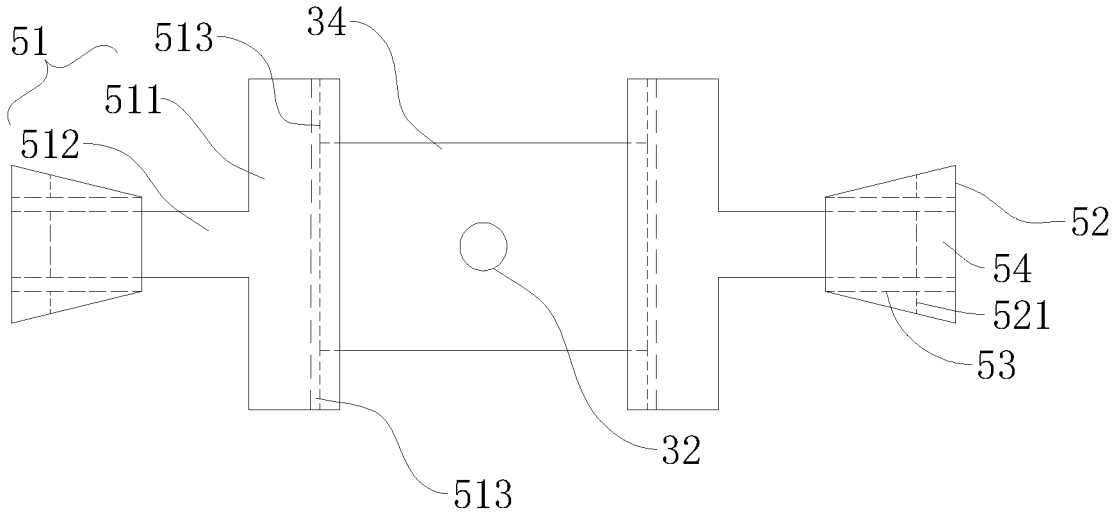
FIG. 10 is a schematic top view when the inserting rods of clamping blocks insert into the block holders and the clamping portions of the clamping blocks fixedly clamp the head block arranged at the upper end of the push-pull rod.

The two steel blocks 54 are used to be removably placed in two block holders 52 of a pair of block holders 52. As shown in FIG. 9 and FIG. 10, when the two steel blocks 54 are placed in the two block holders 52, respectively, and the two clamping blocks 51 are held by the two block holders 52, respectively, the two clamping blocks 51 are close to each other to clamp the head block 34. When the two steel blocks 54 are removed from the two block holders 52, the two clamping blocks 51 are far away from each other to release the head block 34. The head block 34 is fixed when it is clamped by the two clamping blocks 51. The head block 34 is movable after it is released by the two clamping blocks 51 which means the head block 34 is detachably connected with the hold component 5.

As shown in FIG. 1 and FIG. 13, each block holder 52 is provided with a horizontal groove 521 for a steel block 54 to be placed in. The horizontal groove 521 runs through the block holder 52 in the direction of perpendicular to the axis of the block holder 52. The steel block 54 can be placed in or taken out from the horizontal groove 521 from the outside of the block holder 52.

In FIG. 1 and FIG. 14, there are three pairs of block holds 52, i.e., the upper pair, the middle and the lower pair. The two clamping blocks 51 are held by the lower pair of block holders 52. The push-pull rod 32 may be in the pushed position and the pointed rods 31 protrude from the outer cylinders 2. When the recyclable pile foundation needs to be recycled, the two clamping blocks 51 that are held by the lower pair of block holders 52 release the head block 34. Then, the push-pull rod 32 is pulled up to the pulled position and the head block 34 is clamped by the two clamping blocks 51 that are now hold by the upper pair of block holders 52. Describing more specifically, when the recyclable pile foundation needs to be recycled, the following actions happen. At first, the two steel blocks 54 are taken out from the lower pair of block holders 52. Secondly, the two clamping blocks 51 moves far away from each other and releases the head block 34. Thirdly, the push-pull rod 32 is pulled up to the pulled position and the pointed rods 31 retract back into the outer cylinders 2. Fourthly, the upper pair of block holders 52 hold the two clamping blocks 51. Fifthly, the two clamping blocks 51 clamp the head block 34 (at this time, the two clamping blocks 51 are close to each other). At last, the two steel block 54 are placed in the upper pair of block holders 52 to keep the two clamping blocks 51 in the position of close to each other. At this time, the push-pull rod 32 is kept in the pulled position and the pointed rods 31 are kept in the state of retracting, thus the recyclable pile foundation can be recycled. In the above description, the lower and upper pairs of block holders 52 are used. It is possible that the middle and lower pairs of block holders 52 (or other combination such as the upper and the middle pairs of the block holders 52) are used.

Figure 15:
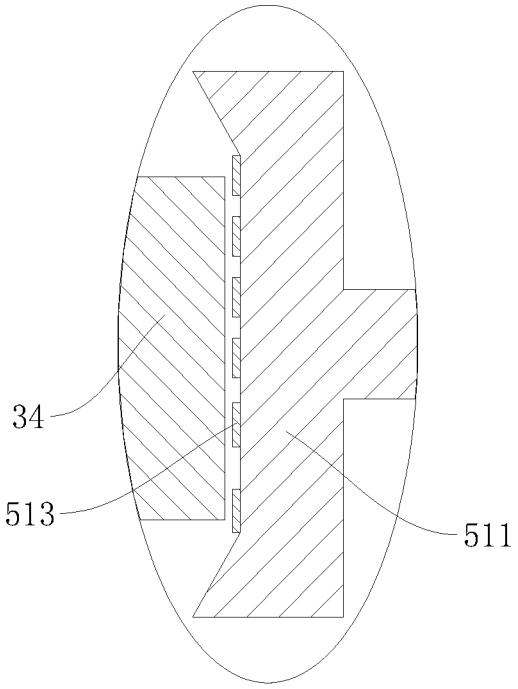
FIG. 15 is an enlarged view of part C of FIG. 9.

In one embodiment, referring to FIG. 9, each of the two clamping blocks 51 is T-shaped and includes a clamping portion 511 and an inserting rod 512. The clamping portion 511 is used to contact and clamp the head block 34, where a contacting surface of the clamping portion 511 for contacting the head block 34 is provided with a plurality of anti-slip patterns 513. An enlarged view of the plurality of anti-slip patterns 513 is shown in FIG. 15. FIG. 15 is an enlarged view of part C of FIG. 9. The anti-slip patterns 513 increase the friction between the clamping portion 511 and the head block 34 so as to increase the clamping force of the clamping blocks 51.

Referring to FIG. 9, the inserting rod 512 is perpendicular to the clamping portion 511 and is used to insert into a blind hole 53 arranged in a block holder 52. When an inserting rod 512 of a clamping block 51 inserts into a blind hole 53 of a block holder 52, the block holder 52 holds the clamping block 51 and the block holder 52 is only movable in the direction along the inserting rod 512. When a steel block 54 of the two steel blocks 54 is placed in a bottom of the blind hole 53 (i.e., the steel block 54 is placed in the horizontal groove 521), the end of the inserting rod 512 inserted into the blind hole 53 is blocked by the steel block 54. Thus, the clamping blocks 51 can't move toward the steel block 54. Therefore, the two clamping blocks 51 keep the state of close to each other and clamp the head block 34.

In one embodiment, referring to FIG. 9, the clamping portion 511 is C-shaped and has at least two convex edges 514 for blocking the head block 34. In FIG. 9, the width of the gap between the two convex edges 514 is less than the width of the head block 34. Therefore, the convex edges 514 can prevent the head block 34 from moving away the two clamping portions 511 if there is no enough friction between the clamping portion 511 and the head block 34, so as to make the head block 34 being clamped.

The above descriptions are only preferred embodiments of the present disclosure, and are not intended to limit the present disclosure. Any modifications, equivalent replacements and improvements made within the spirit and principle of the present disclosure shall be included within the protection scope of the present disclosure.

The invention claimed is:

1. A recyclable pile foundation, comprising:

at least two inner cylinders coaxially distributed along a first axis thereof, wherein adjacent two inner cylinders of the at least two inner cylinders are detachably connected;

at least two outer cylinders coaxially distributed along the first axis, wherein each outer cylinder coaxially surrounds a corresponding inner cylinder of the at least two inner cylinders, and each outer cylinder is connected with the corresponding inner cylinder through at least two steel bars; and at least three reciprocating components circumferentially distributed between the at least two inner cylinders and the at least two outer cylinders, wherein each reciprocating component comprises:

at least two steel collars, wherein each steel collar is welded to a steel bar of the at least two steel bars;

a push-pull rod parallel to the first axis, wherein the push-pull rod passes through the at least two steel collars and is only movable along a second axis of the push-pull rod under a limitation of the at least two steel collars;

a hold component configured to hold the push-pull rod in a pushed position or in a pulled position, wherein the hold component is detachably connected to a head block arranged at an upper end of the push-pull rod; and at least one motion component distributed along the push-pull rod, wherein each motion component comprises:

at least one triangular connection plate, wherein each triangular connection plate is fixedly connected to the push-pull rod;

a plurality of connection rods, wherein each connection rod is fixedly connected to a triangular connection plate of the at least one triangular connection plate;

an inner wedge block fixedly connected to at least one of the plurality of connection rods, wherein the inner wedge block has a first inclined plane;

an outer wedge block fixedly connected to at least one of the plurality of connection rods, wherein the outer wedge block has a second inclined plane opposite and parallel to the first inclined plane;

a motion block arranged between two steel bars of the at least two steel bars, wherein the motion block is only movable perpendicularly to the first axis under a limitation of the two steel bars, the motion block is arranged between the inner wedge block and the outer wedge block and slidably in contact with both the first inclined plane and the second inclined plane; and a pointed rod perpendicular to the first axis and attached to the motion block;

wherein:

when the push-pull rod is pushed along the second axis to the pushed position, the inner wedge block and the outer wedge block move with the push-pull rod to drive the motion block to move, and the pointed rod moves with the motion block and protrudes from an outer cylinder of the at least two outer cylinders passing through a first hole arranged at the outer wedge block and a second hole arranged at the outer cylinder; and when the push-pull rod is pulled along the second axis to the pulled position, the inner wedge block and the outer wedge block move with the push-pull rod to drive the motion block to move, and the pointed rod moves with the motion block and retracts.

2. The recyclable pile foundation according to claim 1, wherein the limitation of the two steel bars is created by two limiting steel plates fixed to the two steel bars respectively, each limiting steel plate is attached with a plurality of rotatable steel balls, the plurality of rotatable steel balls of one limiting steel plate of the two limiting steel plates are in rolling contact with a top surface of the motion block, and the plurality of rotatable steel balls of the other limiting steel plate of the two limiting steel plates are in rolling contact with a bottom surface of the motion block; and the motion block is provided with a through hole for the push-pull rod to pass through, wherein a cross section of the through hole is bar-shaped.

3. The recyclable pile foundation according to claim 2, wherein the pointed rod comprises:

a cylindrical body; and an apex portion comprising at least three right-angled trapezoidal steel plates forming a pointed end.

4. The recyclable pile foundation according to claim 3, further comprising a ring seal portion configured to seal a ring gap between a bottom end of the at least two inner cylinders and a bottom end of the at least two outer cylinders, wherein a longitudinal section of the ring seal portion is cone-shaped.

5. The recyclable pile foundation according to claim 1, wherein the hold component comprises:

two clamping blocks arranged opposite each other and configured to clamp the head block arranged at the upper end of the push-pull rod;

at least two pairs of block holders distributed along the push-pull rod, wherein each pair of block holders comprises two block holders that are arranged opposite each other and that are configured to hold the two clamping blocks respectively, one block holder of the two block holders is fixed on a top inner cylinder of the at least two inner cylinders and the other block holder of the two block holders is fixed on a top outer cylinder of the at least two outer cylinders; and two steel blocks removably placed in the two block holders, respectively, of a pair of block holders of the at least two pairs of block holders;

wherein for each pair of block holders, when the two steel blocks are placed in the two block holders respectively and the two clamping blocks are held by the two block holders respectively, the two clamping blocks clamp the head block; and when the two steel blocks are removed from the two block holders, the two clamping blocks release the head block.

6. The recyclable pile foundation according to claim 5, wherein each clamping block of the two clamping blocks is T-shaped and comprises:

a clamping portion configured to contact and clamp the head block, wherein a contacting surface of the clamping portion for contacting the head block is provided with a plurality of anti-slip patterns; and an inserting rod perpendicular to the clamping portion and configured to insert into a blind hole arranged in a block holder of the at least two pairs of block holders; and wherein when the inserting rod of a corresponding clamping block inserts into the blind hole of the block holder, the block holder holds the corresponding clamping block; and when a steel block of the two steel blocks is placed in a bottom of the blind hole, an end of the inserting rod inserted into the blind hole is blocked by the steel block.

7. The recyclable pile foundation according to claim 6, wherein the clamping portion is C-shaped and has at least two convex edges for blocking the head block.

* * * * *